US009657448B2

(12) United States Patent
Zhou et al.

(10) Patent No.: US 9,657,448 B2
(45) Date of Patent: May 23, 2017

(54) BRIDGE MAINTENANCE VEHICLE WITH HINGE-CONNECTED TYPE HANGING BRACKET AND CAPABLE OF AVOIDING BRIDGE-SIDE OBSTACLES

(71) Applicant: WUDA JUCHENG STRUCTURE CO., LTD., Wuhan, Hubei (CN)

(72) Inventors: Jianbo Zhou, Hubei (CN); Zuoping Gao, Hubei (CN); Mingxiang Chen, Hubei (CN); Youkang Chen, Hubei (CN)

(73) Assignee: WUDA JUCHENGSTRUCTURE CO., LTD., Wuhan, Hubei (CN)

( * ) Notice: Subject to any disclaimer, the term of this patent is extended or adjusted under 35 U.S.C. 154(b) by 0 days.

(21) Appl. No.: 14/602,053

(22) Filed: Jan. 21, 2015

(65) Prior Publication Data

US 2015/0136526 A1 May 21, 2015

Related U.S. Application Data

(63) Continuation of application No. PCT/CN2013/079533, filed on Jul. 17, 2013.

(30) Foreign Application Priority Data

Jul. 24, 2012 (CN) ..... 2012 1 0257144

(51) Int. Cl.
*E01D 19/10* (2006.01)
*E04G 3/28* (2006.01)

(52) U.S. Cl.
CPC ..... *E01D 19/106* (2013.01); *E01D 19/10* (2013.01); *E04G 2003/283* (2013.01)

(58) Field of Classification Search
CPC ..... B60R 3/007; E01D 19/106; E04G 3/22
See application file for complete search history.

(56) References Cited

U.S. PATENT DOCUMENTS 2,155,888 A * 4/1939 Boomgarden ..... E04G 3/22 248/217.1
3,262,517 A * 7/1966 Malec ..... B66F 11/046 182/127

(Continued)

FOREIGN PATENT DOCUMENTS

CN 2839366 Y 11/2006
CN 201010858 Y 1/2008

(Continued)

OTHER PUBLICATIONS

International Search Report issued by State Intellectual Property Office of the P. R. China dated Sep. 10, 2013 for Application No. PTC/CN2013/079533.

(Continued)

*Primary Examiner* — Katherine Mitchell
*Assistant Examiner* — Candace L Bradford
(74) *Attorney, Agent, or Firm* — Tim Tingkang Xia, Esq.; Locke Lord LLP

(57) ABSTRACT

A bridge maintenance vehicle with a hinge-connected hanging bracket for avoiding bridge-side obstacles comprises an unwheeling and a suspension arm. The unwheeling comprises a vehicle frame chassis. The suspension arm is a C-shaped hanging bracket. The vehicle frame chassis is connected to a lower end of a strut in a hinged manner through a longitudinal shaft hinge and a longitudinal shaft. A protruding end of a lower cross beam of the C-shaped hanging bracket is provided with at least a fixing point for a lifting rope or a lifting rope winding/unwinding device. A vehicle frame stringer is fixed at an upper end of the strut. A hanging bracket longitudinal beam is fixed at an upper end of a vertical rod of the C-shaped hanging bracket. The hanging bracket longitudinal beam and the vehicle frame (Continued)

stringer are movably connected with each other into a whole through at least two cross beams.

6 Claims, 12 Drawing Sheets

(56) References Cited

U.S. PATENT DOCUMENTS

| | | | | | |
|---|---|---|---|---|---|
| 3,411,606 | A * | 11/1968 | Oldakowski | B66F 11/044 | 182/2.8 |
| 4,461,369 | A * | 7/1984 | Amador | E01D 19/106 | 182/2.6 |
| 4,646,875 | A * | 3/1987 | Sholl | E01D 19/106 | 182/2.6 |
| 5,318,149 | A * | 6/1994 | Moog | E01D 19/106 | 182/2.6 |
| 5,435,410 | A * | 7/1995 | Langston | B66C 23/78 | 182/2.6 |
| 6,507,163 | B1 * | 1/2003 | Allen | B25J 9/162 | 14/78 |
| 2011/0169939 | A1 * | 7/2011 | Kang | E01D 19/106 | 348/82 |
| 2013/0313044 | A1 * | 11/2013 | Stewart | B66F 11/046 | 182/63.1 |
| 2015/0060205 | A1 * | 3/2015 | Blackwell | B60R 3/02 | 182/223 |

FOREIGN PATENT DOCUMENTS

| | | | | | |
|---|---|---|---|---|---|
| CN | 101215821 | A | | 7/2008 | |
| CN | 201526009 | U | | 7/2010 | |
| CN | 202247709 | U | | 5/2012 | |
| CN | 102797222 | A | | 11/2012 | |
| CN | 202730646 | U | | 2/2013 | |
| DE | EP 0099935 | B1 | * | 11/1985 | B66F 11/044 |
| DE | 8805760 | U1 | | 6/1988 | |
| EP | 0099935 | B1 | * | 11/1985 | B66F 11/044 |
| FR | 2650815 | A1 | * | 2/1991 | B66F 11/044 |
| FR | EP 2506073 | A1 | * | 10/2012 | E01D 19/106 |
| GB | 1484263 | A | * | 9/1977 | B66F 11/044 |
| GB | WO 2010049367 | A2 | * | 5/2010 | F23J 1/02 |

OTHER PUBLICATIONS

State Intellectual Property Office of the P. R. China, "First Office Action", 201210257144.6, China, Jan. 30, 2014.

State Intellectual Property Office of the P. R. China, "Second Office Action", 201210257144.6, China, Jul. 2, 2014.

* cited by examiner

BRIDGE MAINTENANCE VEHICLE WITH HINGE-CONNECTED TYPE HANGING BRACKET AND CAPABLE OF AVOIDING BRIDGE-SIDE OBSTACLES

CROSS-REFERENCE TO RELATED APPLICATIONS

This application is a continuation application of International Patent Application No. PCT/CN2013/079533, filed Jul. 17, 2013, entitled "BRIDGE MAINTENANCE VEHICLE WITH HINGE-CONNECTED TYPE HANGING BRACKET AND CAPABLE OF AVOIDING BRIDGE-SIDE OBSTACLES," by Jianbo ZHOU et al, which itself claims the priority to Chinese Patent Application No. 201210257144.6, filed Jul. 24, 2012 in the State Intellectual Property Office of P.R. China, entitled "BRIDGE MAINTENANCE VEHICLE WITH HINGE-CONNECTED TYPE HANGING BRACKET AND CAPABLE OF AVOIDING BRIDGE-SIDE OBSTACLES," by Jianbo ZHOU et al, which are hereby incorporated herein in their entireties by reference.

Some references, which may include patents, patent applications and various publications, are cited and discussed in the description of this invention. The citation and/or discussion of such references is provided merely to clarify the description of the present invention and is not an admission that any such reference is "prior art" to the present invention described herein. All references cited and discussed in this specification are incorporated herein by reference in their entireties and to the same extent as if each reference was individually incorporated by reference.

FIELD OF THE INVENTION

The present invention relates to a bridge inspection, maintenance and construction device, in particular, to a hanging bracket hinged bridge maintenance vehicle erected on sidewalks on two sides of a bridge, capable of providing a lifting point for a working platform for inspection and maintenance of a bridge underside and capable of avoiding bridge-side obstacles.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the present invention.

To provide a mobile operating platform for maintenance of a bridge underside with heavy traffic, a patent application was filed to the State Intellectual Property Office on Apr. 17, 2012, with No. 2012101125274 and title "BRIDGE MAINTENANCE VEHICLE WITH HINGE-CONNECTED TYPE HANGING BRACKET", referring to FIG. 1 to FIG. 6. The maintenance vehicle includes a vehicle frame and a suspension arm capable of extending outside of a bridge. The vehicle frame includes a vehicle frame chassis. The suspension arm is a C-shaped hanging bracket. The vehicle frame chassis hinges a lower end of a strut through a longitudinal shaft hinge together with a longitudinal shaft. An upper end of the strut hinges a extending end of an upper cross beam of the C-shaped hanging bracket through a horizontal shaft hinge and a horizontal shaft; or the vehicle frame chassis hinges the extending end of the upper cross beam of the C-shaped hanging bracket through a universal joint or a spherical hinge; or the vehicle frame chassis hinges the extending end of the upper cross beam of the C-shaped hanging bracket through the longitudinal shaft hinge and the longitudinal shaft, and an extending end of a lower cross beam of the C-shaped hanging bracket is provided with at least a fixing point for a lifting rope or a lifting rope winding/unwinding device. The strut and the C-shaped hanging bracket form an inverted G-shaped rigid frame in a plane, which can avoid bridge-side railings and directly transfer pulling force of the lifting rope of a maintenance platform to a deck, with a small overturning moment and a compact structure, easy to assemble and use, capable of being erected on sidewalks on two sides of the bridge, not occupying lanes, not affecting vehicle traffic on the deck in use, and especially applicable to projects of inspection and maintenance on an underside of a bridge with heavy traffic. However, the maintenance vehicle may often be obstructed by cables or lampposts on two sides of the bridge during construction. In this case, it is necessary to consider arranging two sets of vehicle frames on two sides of the deck respectively, that is, two vehicle frames are arranged on each side of the bridge respectively, so as to avoid cables, lampposts or other obstacles on two sides of the bridge by alternating forces of the lifting ropes on C-shaped hanging brackets of the two vehicle frames and by replacing lifting points of the lifting ropes to make the lifting ropes swing and transit between the two C-shaped hanging brackets, thereby realizing movement of the operating platform at the bottom of the bridge. During the above process of avoiding obstacles, it is necessary to assemble two additional maintenance vehicles respectively on the two sides of the deck and to frequently change the lifting points of the lifting ropes of the underbridge operating platform to transit and avoid the obstacles, which costs lots of labors and time, has high construction costs, and is inefficient and cumbersome. Lifting equipment is also needed during on-site assembling of the maintenance vehicles, which would temporarily occupy the lane and affect the traffic.

SUMMARY OF THE INVENTION

One of the objectives of the present invention is to provide a hanging bracket hinged bridge maintenance vehicle for avoiding bridge-side obstacles, which has a simple structure, easy to use and capable of quickly avoiding bridge-side obstacles. The present invention overcomes the shortcomings of the existing hanging bracket hinged bridge maintenance vehicles such as using too many devices, high costs, low efficiency, high labor costs, and affecting traffic on the deck. The present invention maintains the advantages of the existing hanging bracket hinged bridge maintenance vehicles such as small overturning moment, lightweight structure, easy to assemble and use, and not occupying the lane. And it is unnecessary for the present invention to use additional devices while avoiding obstacles, which does not affect the traffic on the deck, saves labor and costs, and quick to avoid obstacles. The present invention is suitable for inspection and maintenance projects under bridges with heavy traffic.

One aspect of the present invention includes a hanging bracket hinged bridge maintenance vehicle for avoiding bridge-side obstacles, comprising a vehicle frame and a suspension arm capable of extending outside of a bridge. The vehicle frame includes a vehicle frame chassis. The suspension arm is a C-shaped hanging bracket. The vehicle frame chassis hinges a lower end of a strut through a longitudinal shaft hinge together with a longitudinal shaft. An extending end of a cross beam below the C-shaped hanging bracket is provided with at least a fixing point for a lifting rope or a lifting rope winding/unwinding device. A vehicle frame stringer is fixed at an upper end of the strut. A hanging bracket stringer is fixed at an upper end of a vertical rod of the C-shaped hanging bracket, and the hanging bracket stringer and the vehicle frame stringer are flexibly connected with at least two cross beams as a whole.

In one embodiment, the hanging bracket stringer and the cross beams on the vehicle frame stringer are arranged at intervals, and the minimum distance between the two adjacent cross beams is greater than the length of the bridge-side obstacles in the longitudinal direction of the bridge.

In one embodiment, the vehicle frame stringer and the hanging bracket stringer are provided with transverse sockets at the corresponding intervals, and the cross beams are provided with shafts to slide fit with the transverse sockets.

In one embodiment, the hanging bracket stringer is provided with transverse sockets corresponding to the cross beams. The cross beams are telescopic beams with more than two sections, wherein the fixed parts of the telescopic beams are fixed to or hinged the vehicle frame stringer, and front ends of telescopic portions of the cross beams are provided with shafts to slide fit or threaded connected with the transverse sockets on the hanging bracket stringer.

In certain embodiments, at least one of the vehicle frame stringer and the hanging bracket stringer are provided with axial movement stop apparatuses corresponding to the transverse sockets, and positioning slots are defined on the shafts on two ends of the cross beams corresponding to the axial movement stop apparatuses.

In certain embodiments, the axial movement stop apparatuses are spring hit beads, and the positioning slots are spherical recesses or annular grooves arranged on the cross beams corresponding to the spring hit beads.

The stringer (i.e., longitudinal shaft or longitudinal beam) is arranged longitudinally along the vehicle frame chassis, wherein longitudinally along the vehicle frame chassis is along the bridge. The horizontal shaft or the horizontal beam is arranged horizontally along the vehicle frame chassis, wherein horizontally along the vehicle frame chassis is along the cross section of the bridge.

The upper cross beam of the C-shaped hanging bracket refers to a part arranged horizontally or bent upwards on the upper part of the C-shaped hanging bracket; the lower cross beam of the C-shaped hanging bracket refers to a part arranged horizontally or bent downwards on the lower part of the C-shaped hanging bracket; and the vertical rod of the C-shaped hanging bracket refers to a part arranged vertically or bent laterally, whose upper and lower ends are connected to the upper cross beam and the lower cross beam respectively. The upper cross beam, the lower cross beam and the vertical rod are altogether formed as the C-shaped hanging bracket. The cross beam in the present invention is equivalent to the upper cross beam in the C-shaped hanging bracket.

Compared with the prior art, the present invention has the following benefits. 1. Keeping the advantages of the existing vehicle frame chassis such as narrower width, light weighted, compact structure, easy to assemble and use, and capable of being erected on sidewalks and pushed by manual labors. 2. Avoiding obstacles by improving the upper cross beam of the C-shaped hanging bracket by changing the upper cross beam from fixed to movable. 3. Connecting multiple cross beams to the vehicle frame stringer and the hanging bracket stringer, which enables the strut and the C-shaped hanging bracket to be connected as a whole and form an inverted G-shaped rigid frame in a section of the bridge at regular times, thereby avoiding bridge-side railings and directly transferring pulling force of the lifting rope of the maintenance platform to the deck. When encountering bridge-side cables, bridge-side lampposts or other obstacles, alternating forces to sustain and transfer loads, which ensure that, when one cross beam is disconnected, the rest remains in connection, thereby ensuring performance of the C-shaped hanging bracket. During the traveling of the vehicle frame, avoiding an obstacle by disconnecting a cross beam from the hanging bracket stringer, and resuming the connection between the upper cross beam and the hanging bracket stringer upon completion of avoidance, and repeating the process of avoiding the next cross beam in sequence. This solves the problem of avoiding the bridge-side obstacles during construction for the same maintenance vehicle, thus is safe and reliable. 4. The cross beams applying the telescopic structure like the arm of a crane, and is technically mature. 5. Using a double bolts fixing manner at the fixing ends of the cross beams. When the telescopic ends are disengaged with the transverse sockets, one bolt is pulled out so as to avoid obstacles in a deflection manner, which reduces telescopic sections of the cross beams. 6. Having a simple structure, being easy to operate to avoid obstacles and convenient in construction, saving labors, not requiring additional devices, not occupying lanes, not affecting traffic on the deck, adapting well to the bridge, and improving construction efficiency.

These and other aspects of the present invention will become apparent from the following description of the preferred embodiment taken in conjunction with the following drawings, although variations and modifications therein is affected without departing from the spirit and scope of the novel concepts of the present invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present invention to the specific embodiments disclosed and described herein. The drawings are not necessarily to scale, emphasis instead being placed upon clearly illustrating the principles of the invention.

Figure 1:
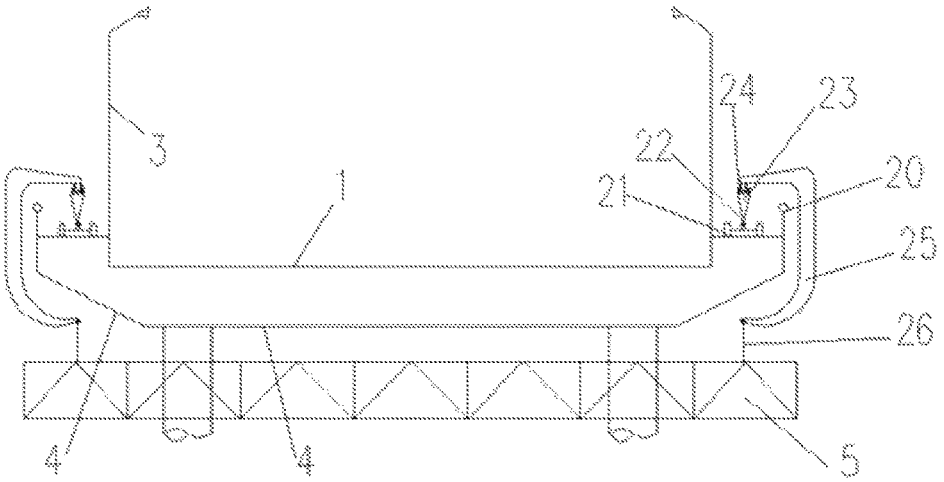
FIG. 1 is a schematic structural view of a conventional maintenance vehicle.

In the above figures: pier 1, deck 2, lamppost 3, bridge underside 4, maintenance stand 5, obstacle 6, bridge-side railing 20, vehicle frame chassis 21, longitudinal shaft 22*a*, longitudinal shaft hinge 22, strut 23, horizontal shaft hinge 24, C-shaped hanging bracket 25, lifting rope 26, wheel 27, universal joint 30, spherical hinge 31, short column 32, cross beam 41, hanging bracket stringer 42, transverse socket 43, vehicle frame stringer 44, bolt 45, and axial movement stop apparatuses 46.

DETAILED DESCRIPTION OF THE INVENTION

The present invention will now be described more fully hereinafter with reference to the accompanying drawings, in which exemplary embodiments of the present invention are shown. This invention may, however, be embodied in many different forms and should not be construed as limited to the embodiments set forth herein. Rather, these embodiments are provided so that this disclosure will be thorough and complete, and will fully convey the scope of the present invention to those skilled in the art. Like reference numerals refer to like elements throughout.

The terms used in this specification generally have their ordinary meanings in the art, within the context of the present invention, and in the specific context where each term is used. Certain terms that are used to describe the present invention are discussed below, or elsewhere in the specification, to provide additional guidance to the practitioner regarding the description of the present invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the present invention or of any exemplified term. Likewise, the present invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions and/or sections, these elements, components, regions and/or sections should not be limited by these terms. These terms are only used to distinguish one element, component, region or section from another element, component, region or section. Thus, a first element, component, region or section discussed below can be termed a second element, component, region or section without departing from the teachings of the present invention.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "comprises" and/or "comprising", or "includes" and/or "including" or "has" and/or "having" when used in this specification specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present invention, and will not be interpreted in an idealized or overly formal sense unless expressly so defined herein.

As used herein, "around", "about", "substantially" or "approximately" shall generally mean within 20 percent, preferably within 10 percent, and more preferably within 5 percent of a given value or range. Numerical quantities given herein are approximate, meaning that the terms "around", "about", "substantially" or "approximately" can be inferred if not expressly stated.

As used herein, the terms "comprise" or "comprising", "include" or "including", "carry" or "carrying", "has/have" or "having", "contain" or "containing", "involve" or "involving" and the like are to be understood to be open-ended, i.e., to mean including but not limited to.

The description below is merely illustrative in nature and is in no way intended to limit the present invention, its application, or uses. The broad teachings of the present invention can be implemented in a variety of forms. Therefore, while this disclosure includes particular examples, the true scope of the present invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the present invention.

Figure 2:
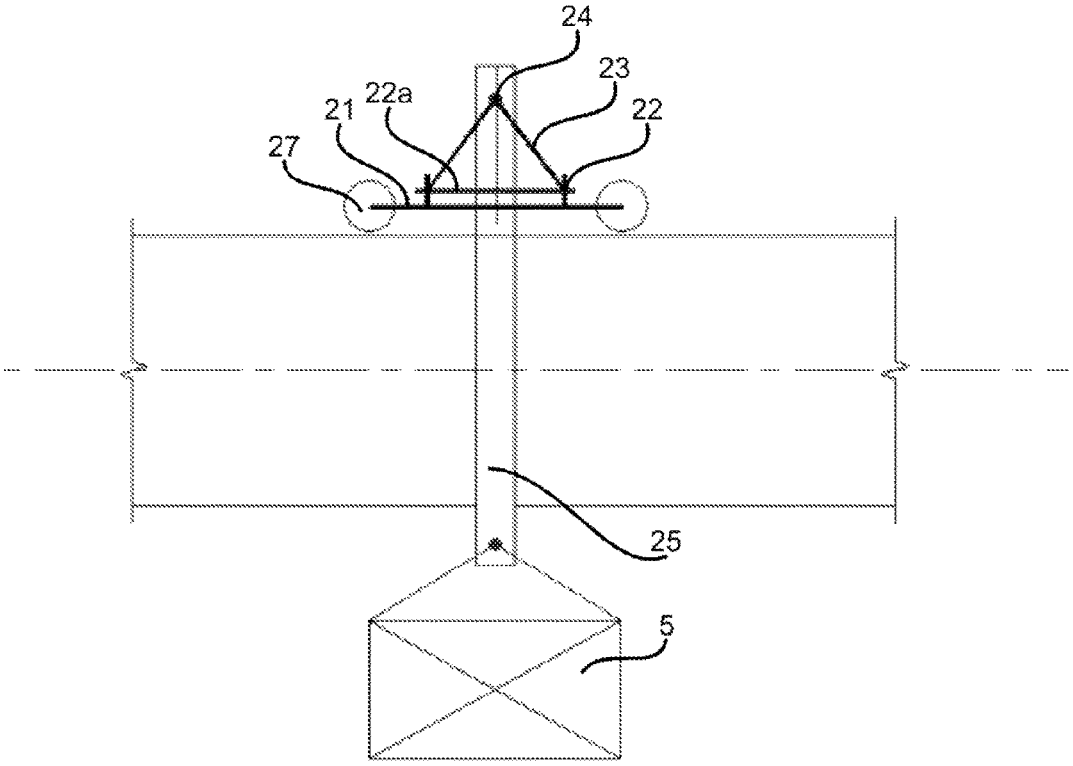
FIG. 2 is a right view of FIG. 1.

In one aspect, referring to FIGS. 1 and 2, a structure of an existing hanging bracket hinged bridge maintenance vehicle according to one embodiment, including a vehicle frame and a suspension arm capable of extending outside of a bridge. The vehicle frame includes a vehicle frame chassis 21 and a strut 23. The suspension arm is a C-shaped hanging bracket 25. The vehicle frame chassis 21 hinges a lower end of a strut 23 through a longitudinal shaft hinge 22 together with a longitudinal shaft 22*a*. An upper end of the strut 23 hinges an extending end of an upper cross beam of the C-shaped hanging bracket 25 through a horizontal shaft hinge 24 and a horizontal shaft, and an extending end of a lower cross beam of the C-shaped hanging bracket 25 is provided with at least a fixing point for a lifting rope 26 or a lifting rope winding/unwinding device.

When the existing maintenance vehicle operates, there are two vehicle frames arranged on sidewalks on two sides of a deck respectively. The vehicle frames each include a vehicle frame chassis 21, a strut 23 hinges the vehicle frame chassis 21 along a longitudinal shaft, and a C-shaped hanging bracket 25 hinges the top of the strut 23 along a horizontal shaft. An upper cross beam of the C-shaped hanging bracket 25 extends beyond the deck and then extends downwards along the vertical rod, and after it extends to a bridge underside 4, a lower cross beam extends inwards to a lower side of the vehicle frame chassis 21. An extending end of the lower cross beam of the C-shaped hanging bracket 25 provides a lifting point of a lifting rope 26 for an under-bridge maintenance platform, and the lifting point of the C-shaped hanging bracket is connected to a lifting point on one end of a maintenance stand 5 through the lifting rope 26.

The width of the vehicle frame chassis 21 is less than that of the sidewalk, and the width of the vehicle frame is narrow so as to avoid all obstacles when moving on the sidewalk. The appropriate maximum width of the vehicle frame chassis 21 is to avoid all obstacles on the sidewalk. The length of the vehicle frame chassis 21 can be set as needed, as long as to satisfy the maximum longitudinal overturning moment produced by the strut 23. In certain embodiments, the longitudinal length of the vehicle frame chassis 21 is 1 to 6 times of the transverse width.

For the structure in FIG. 1 and FIG. 2, the vehicle frame chassis 21 is provided with a perforated hinge base in the center of the width, and a lower portion of the strut 23 is also correspondingly provided with a perforated hinge base. The longitudinal shaft hinge 22 is formed by the perforated hinge bases arranged on the vehicle frame chassis 21 and the strut 23 respectively. The longitudinal shaft hinge 22 is provided with a longitudinal shaft, that is, the longitudinal shaft passes through the perforated hinge bases on the vehicle frame chassis 21 and the strut 23, so as to hinge the vehicle frame chassis 21 and the strut 23, and the strut 23 can rotate about the longitudinal shaft relative to the vehicle frame chassis 21. The smaller the height to the road of the longitudinal shaft that hinges the vehicle frame chassis 21 and the strut 23, the better the vehicle frame chassis 21 anti-overturns transversely.

The top of the strut 23 is provided with a perforated hinge base in the center of the length of the vehicle frame chassis 21. The bottom surface of the extending end of the upper cross beam of the C-shaped hanging bracket 25 is also provided with a perforated hinge base correspondingly. The horizontal shaft hinge 24 is formed by the perforated hinge bases arranged on the strut and the C-shaped hanging bracket 25 respectively, and the horizontal shaft hinge 24 is provided with a horizontal shaft, so as to form a hinged connection, that is, the strut 23 hinges the perforated hinge base on the extending end of the upper cross beam of the C-shaped hanging bracket 25 through the horizontal shaft so that the C-shaped hanging bracket 25 can rotate about the horizontal shaft relative to the strut 23. The horizontal shaft, which hinges the strut 23 and the C-shaped hanging bracket 25, is arranged on the top of the strut 23, so as to facilitate on-site assembly of each part. But there are certain longitudinal anti-overturning requirements for the vehicle frame chassis 21. The lower the height of the horizontal shaft, that is, the closer the horizontal shaft to the vehicle frame chassis 21, the better the vehicle frame chassis 21 anti-overturns longitudinally.

Figure 3:
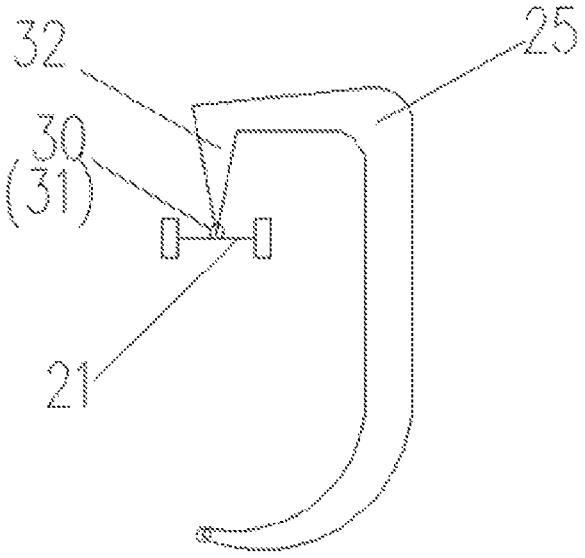
FIG. 3 is a schematic structural view showing one embodiment of the conventional maintenance vehicle that uses a universal joint 30 or a spherical hinge 31.
Figure 4:
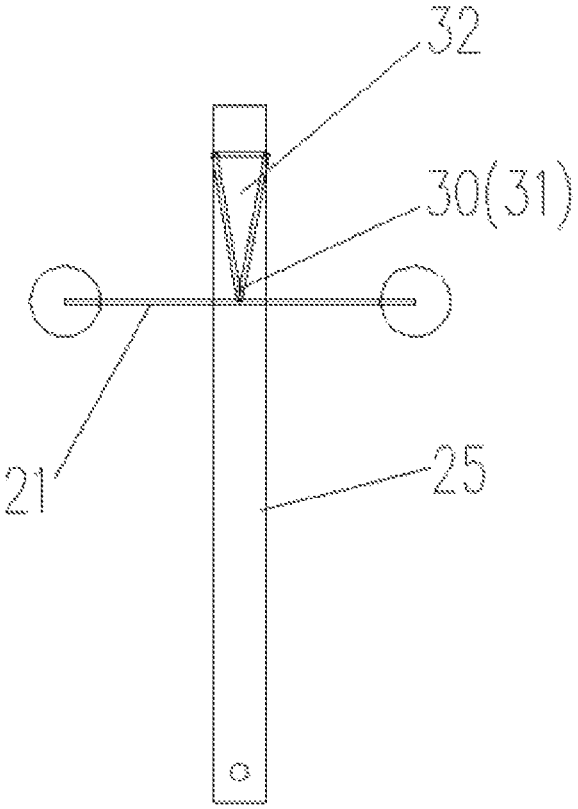
FIG. 4 is a left view of FIG. 3.

According to the embodiment of FIG. 1, FIG. 3 and FIG. 4, when the longitudinal shaft 22 and the horizontal shaft 24 are both arranged on the vehicle frame chassis 21, it is equivalent to that the vehicle frame chassis 21 and the short column 32 of the C-shaped hanging bracket 25 are connected through a universal joint 30, wherein the universal joint 30 may be replaced with a spherical hinge 31. That is, the vehicle frame chassis 21 is connected to the extending end of the upper cross beam of the C-shaped hanging bracket 25 through the universal joint 30 or the spherical hinge 31. The extending end of the upper cross beam of the C-shaped hanging bracket 25 extends downward to form the short column 32. The short column 32 can be an inverted cone with a big-end-up cross section, a wedge, or a uniform column. The universal joint 30 has the same structure as the universal joint on an automobile transmission shaft. The universal joint 30 is vertically placed and allows the plane to rotate in all directions, but only restricts rotation of the vertical shaft. The lower end of the universal joint 30 is fixed to the vehicle frame chassis 21, and the upper end of the universal joint 30 is connected to the short column 32 on the extending end of the upper cross beam of the C-shaped hanging bracket 25. The spherical hinge 31 is formed by a lower bearing, a spherical body and an upper bearing. The spherical body is arranged between the upper bearing and the lower bearing. The upper bearing and the lower bearing are respectively connected to the vehicle frame chassis 21 and the short column 32 on the extending end of the upper cross beam of the C-shaped hanging bracket 25.

The vehicle frame chassis 21 is a quadrangle, for example, a rectangle. Four wheels 27 are arranged underneath the vehicle frame chassis 21. The vehicle frame chassis 21 is driven by manual labors, or driven by power by providing a power unit such as a motor and a reducer on two of the wheels 27 may also be, so as to form power-drive. The strut 23 is a part that can withstand bending. The height from the bottom of the vehicle frame chassis 21 to the top of the strut 23 is generally greater than the height of the railing on the outer side of the sidewalk.

To make force applied to the strut 23 reasonable, the cross section of the strut 23 has a shape of an inverted triangle; the longitudinal section of the strut 23 has a shape of an inverted triangle; the longitudinal centerline of the vehicle frame chassis 21 and a corner at the lower part of the cross section of the strut 23 are provided with perforated hinge bases; a corner at the upper part of the longitudinal section of the strut 23 and the extending end on the bottom surface of the upper cross beam of the C-shaped hanging bracket 25 are respectively provided with perforated hinge bases; and a space truss structure can be used to reduce the weight. The strut 23 may also be made into a rectangular frame.

The C-shaped hanging bracket 25 is a C-shaped part, and the upper and lower endpoints of an opening of the part can withstand the effect of a pair of tension forces. It is appropriate that the upper cross beam of the C-shaped hanging bracket 25 enables the vertical rod on the C-shaped hanging bracket 25 to hang outside the deck 2. It is appropriate that the length of the vertical rod of the C-shaped hanging bracket 25 enables the lower cross beam to extend below the bridge underside 4. The length of the lower cross beam of the C-shaped hanging bracket 25 is greater than or equal to that of the upper cross beam. The extending end of the lower cross beam provides a lifting point and a fixing point for securing the lifting rope 26 of the maintenance stand 5.

The height of the vertical rod of the C-shaped hanging bracket 25 is greater than the height from the top of the bridge-side railing 20 to the bridge underside 4, so as to enable the lower cross beam of the C-shaped hanging bracket 25 to extend below the bridge underside 4. The length of the upper cross beam of the C-shaped hanging bracket 25 is greater than the width from the center of the sidewalk of the bridge to the outer side of the bridge-side railing 20, so that the upper cross beam of the C-shaped hanging bracket 25 extends to the outer side of the bridge from the sidewalk on the bridge. And the length of the lower cross beam of the C-shaped hanging bracket 25 is greater than or equal to that of the upper cross beam of the C-shaped hanging bracket 25, so that the lower cross beam of the C-shaped hanging bracket 25 extends from an outer side of a cross section of the bridge to an inner side at the bridge underside, with a certain latitude of swinging and stretching transversely to the bridge. The C-shaped hanging bracket 25 is a part subject to tension, bending and shear forces, and the C-shaped hanging bracket 25 is a box-plate part or a truss part.

The extending end of the lower cross beam of the C-shaped hanging bracket 25 is provided with two lifting rope fixing points. That is, two lifting ropes 26 may be disposed at the extending end of the lower cross beam of the C-shaped hanging bracket 25 to connect to the maintenance stand 5, thereby increasing security. A lifting rope winding/unwinding device can also be arranged on the lower cross beam of the C-shaped hanging bracket 25. The lifting rope winding/unwinding device is an electric hoist. For example, the electric hoist is fixed to the extending end of the lower cross beam of the C-shaped hanging bracket 25, and the steel rope on the electric hoist is connected to the maintenance stand 5, or the hook on the electric hoist is connected to the steel rope secured on the maintenance stand 5. An operator switches on the electric hoist from the deck or the maintenance stand 5, so as to operate the electric hoist to rotate, and can drive one end of the maintenance stand 5 to go up and down.

Figure 5:
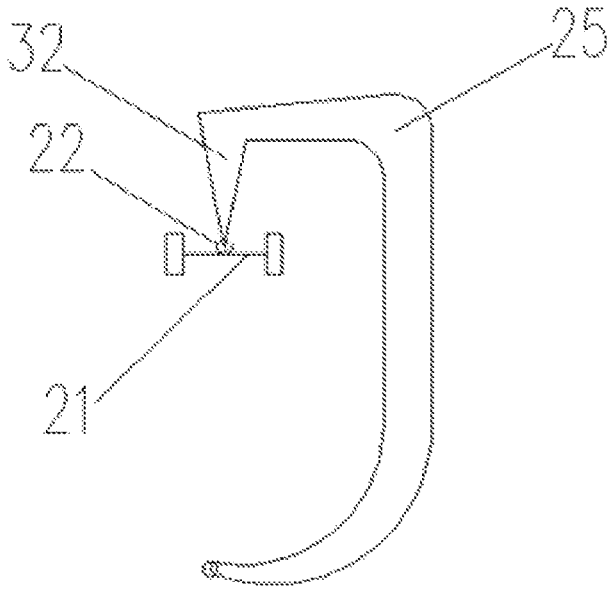
FIG. 5 is a schematic structural view of another embodiment of a conventional maintenance vehicle.
Figure 6:
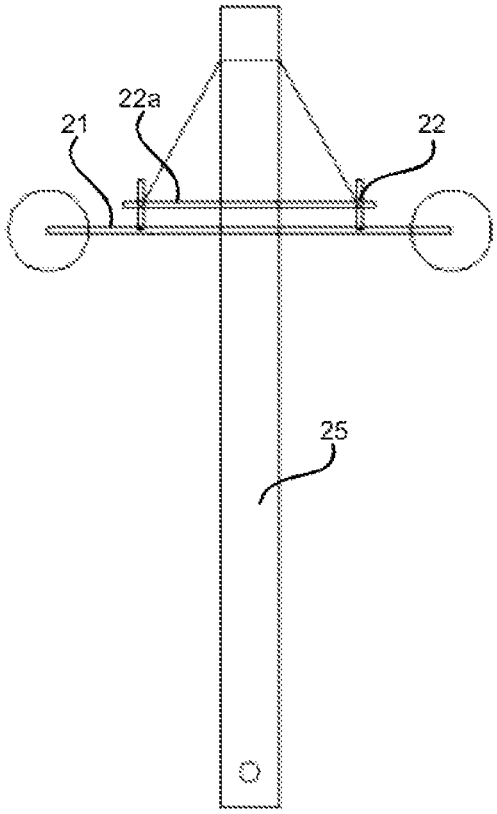
FIG. 6 is a left view of FIG. 5.

In another embodiment, referring to FIG. 5 and FIG. 6, a structure of the existing conventional maintenance vehicle is as follows: the vehicle frame chassis 21 hinges to an extending end of an upper cross beam of the C-shaped hanging bracket 25 through a longitudinal shaft hinge 22 and a longitudinal shaft 22*a*. That is, strut 23 is cancelled, the bottom of the short column 32 on the extending end of the upper cross beam of the C-shaped hanging bracket 25 directly hinges the longitudinal shaft of the vehicle frame chassis 21, which may also be understood as cancelling the perforated hinge base on the upper end of the strut 23 and connecting the strut 23 and the bottom of the protruding end of the upper cross beam of the C-shaped hanging bracket 25 as a whole. In other words, the protruding end of the upper cross beam of the C-shaped hanging bracket 25 extends downward to form a short column 32, and a longitudinal center line of the vehicle frame chassis 21 and a lower side of a cross section of the short column 32 are provided with perforated hinge bases. The longitudinal shaft hinge 22 is formed by the perforated hinge bases arranged on the vehicle frame chassis 21 and the short column 32 respectively. A longitudinal shaft 22*a* passes through the longitudinal shaft hinge 22, that is, the longitudinal shaft 22*a* passes through the perforated hinge bases on the vehicle frame chassis 21 and the short column 32 to form a hinged connection. An extending end of a lower cross beam of the C-shaped hanging bracket 25 is provided with at least a fixing point for a lifting rope 26 or a lifting rope winding/unwinding device. The C-shaped hanging bracket 25 in this structure can rotate about the longitudinal shaft 22*a*, so that the lower cross beam of the C-shaped hanging bracket 25 extends below the bridge underside 4, thereby providing a lifting point for the lifting rope 26 to lift the maintenance stand 5. However, due to the absence of the horizontal shaft hinge 24, when the vehicle frame of the structure is located on an uphill section and a downhill section of an arched deck, the direction of center of gravity of the vehicle frame and the perpendicular bisector of a chord corresponding to the arc where the vehicle frame is on forms a certain angle. That is, the direction of center of gravity of the vehicle frame is perpendicular to the horizontal plane, the longitudinal shaft 22*a* on the vehicle frame chassis 21 and the horizontal plane form a certain angle, the C-shaped hanging bracket 25 is perpendicular to the longitudinal shaft 22*a*, and forms an angle with the center of gravity of the vehicle frame chassis 21. In this case, the lower cross beam of the C-shaped hanging bracket 25 may produce certain torque relative to the upper cross beam and the longitudinal shaft 22*a*, which deteriorates the force on the C-shaped hanging bracket 25 and the vehicle frame chassis 21. Therefore, it is recommended that the structure is only used for maintenance of a non-sloped flat bridge.

In this embodiment, the vehicle frame chassis 21 is provided with a perforated hinge base of a longitudinal shaft 22*a* in the center of the width, and a lower portion of the short column 32 is also provided with a perforated hinge base correspondingly. The longitudinal shaft hinge 22 is formed by the perforated hinge bases arranged on the vehicle frame chassis 21 and the short column 32 on the extending end of the upper cross beam of the C-shaped hanging bracket 25 correspondingly, and a longitudinal shaft 22*a* passes through the longitudinal shaft hinge 22.

In another aspect, a method of performing a bridge maintenance operation by using the maintenance vehicle is as follows. In one embodiment, two sets of vehicle frame chassis 21, struts 23 and C-shaped hanging brackets 25 are respectively transported to sidewalks on two sides of a bridge. A longitudinal shaft 22*a* penetrates a longitudinal shaft hinge 22 to erect the strut 23 on the vehicle frame chassis 21, and a horizontal shaft penetrates a horizontal shaft hinge 24 to fix the upper cross beam of the C-shaped hanging bracket 25 onto the strut 23. The lower cross beam thereof is placed underneath the bridge underside 4 from the outer side of the bridge. Therefore, two sets of overall vehicle frames are assembled on site. Alternatively, two sets of vehicle frame chassis 21 and C-shaped hanging brackets 25 with short columns 32 are transported to the sidewalks on two sides of the bridge respectively, and the vehicle frame chassis 21 is connected with the short column 32 on an extending end of an upper cross beam of the C-shaped hanging bracket 25 through a universal joint 30 or a spherical hinge 31. The lower cross beam of the C-shaped hanging bracket 25 is placed underneath the bridge underside 4 from the outer side of the bridge. Therefore, two whole sets of vehicle frames are assembled on site.

In another embodiment, two sets of vehicle frame chassis 21 and C-shaped hanging brackets 25 are transported to sidewalks on two sides of a bridge respectively, and a longitudinal shaft 22*a* penetrates a longitudinal shaft hinge 22 to fix an upper cross beam of the C-shaped hanging bracket 25 onto the vehicle frame chassis 21. A lower cross beam is placed underneath the bridge underside 4 from the outer side of the bridge. Therefore two whole sets of vehicle frames are assembled on site.

In the above assembly process, it is necessary to take certain lifting and supporting measures, to ensure that the strut 23 or the C-shaped hanging bracket 25 is upright without rotating about the longitudinal shaft, the universal joint 30 or the spherical hinge 31, and to ensure that the upper cross beam of the C-shaped hanging bracket 25 is substantially parallel to the deck 2 without rotating about the longitudinal shaft, the universal joint 30 or the spherical hinge 31 towards the bridge underside 4. Meanwhile, wheels 27 on the vehicle frame chassis 21 are blocked by wedges respectively to stop the wheels 27 from rotating and to prevent car from slipping, which provides two fixed lifting points for lifting the assembled maintenance stand 5 under-bridge.

Steel ropes are secured on two ends of the maintenance stand 5, the two ends are lifted synchronously by using a hoist device, to lift the maintenance stand 5 to a suitable working height. Then lifting ropes 26 are used to fix the two ends of the maintenance stand 5 to fixing points of the lifting ropes 26 on lower cross beams of two C-shaped hanging brackets 25 respectively. The lifting ropes 26 are fastened and locked, and if necessary, a protection rope may be added to fix the maintenance stand 5 so as to prevent shaking and swinging. A lifting steel rope on the hoist device is removed, so that two ends of the maintenance stand 5 are hung vertically on the two C-shaped hanging brackets 25.

After the maintenance stand 5 is hung on the two C-shaped hanging brackets 25, due to the effect of gravity of the maintenance stand 5, rotation of the strut 23 about the longitudinal shaft and rotation of the C-shaped hanging bracket 25 about the horizontal shaft are limited, and rotation of the C-shaped hanging bracket 25 about the universal joint 30, the spherical hinge 31 or the longitudinal shaft is also limited. Just like a person in a house hooks a hook on a beam, the person may pull the rope to climb up, but the hook may not easily flip or fall. Then lifting and supporting measures arranged near the strut 23 and the C-shaped hanging bracket 25 can be removed, so that the two maintenance vehicles are ready for use. The maintenance vehicles provide safe and secure operating platforms for the bridge underside. A ladder is placed on a side of the bridge, maintenance personnel may enter the maintenance stand 5 from the ladder on the side of the bridge, so as to perform maintenance or construction. After the operations on a working section is completed, the wedges blocked below the wheels 27 are loosened on the sidewalk of the deck 2, two vehicle frames are manually pushed to advance so as to drive the maintenance stand 5 to a new working surface, and then the following maintenance work continues.

However, when the maintenance vehicle is used for maintaining a bridge with cables on the sides or with lampposts, the maintenance vehicle will be hampered by the bridge-side obstacles like cables or lampposts. In this case, it is necessary to arrange two vehicle frames in sequence on two sides of the bridge, the C-shaped hanging brackets 25 on two vehicle frames on the same side of the bridge extend to the outer side of the bridge from gaps of different cables respectively, and lifting ropes 26 in lower portions of the C-shaped hanging brackets 25 on two vehicle frames on the same side of the bridge are respectively secured on the same corresponding end on the maintenance stand 5. The two C-shaped hanging brackets 25 and vehicle frames are alternately moved by alternating forces on the lifting ropes 26 on the two C-shaped hanging brackets 25, thereby avoiding obstruction from the cables on the sides of the bridge. Although the maintenance vehicle does not occupy the lane while working, it is necessary to use additional hoist device in the case of on-site assembling the maintenance vehicle and alternating two vehicle frames, which might temporarily occupy the lane and affect traffic.

Figure 7:
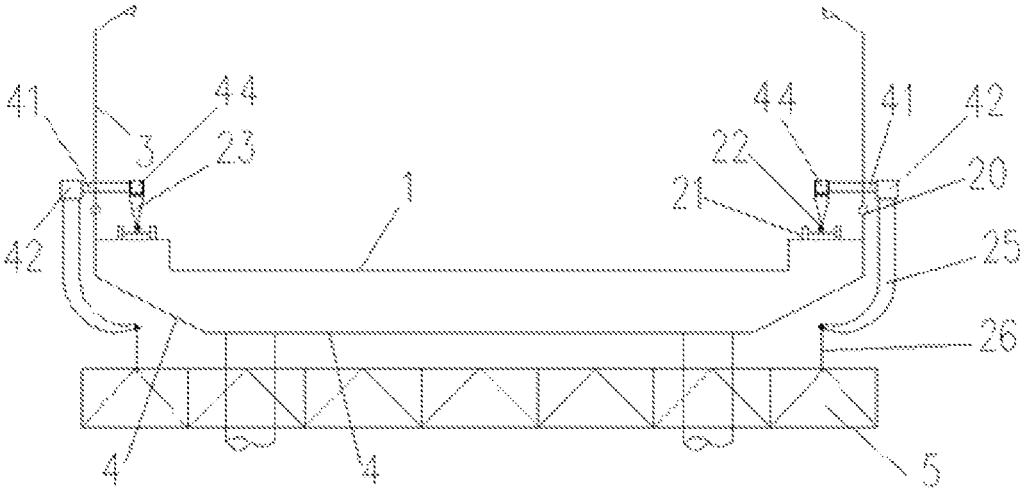
FIG. 7 is a schematic structural view according to one embodiment of the present invention.
Figure 8:
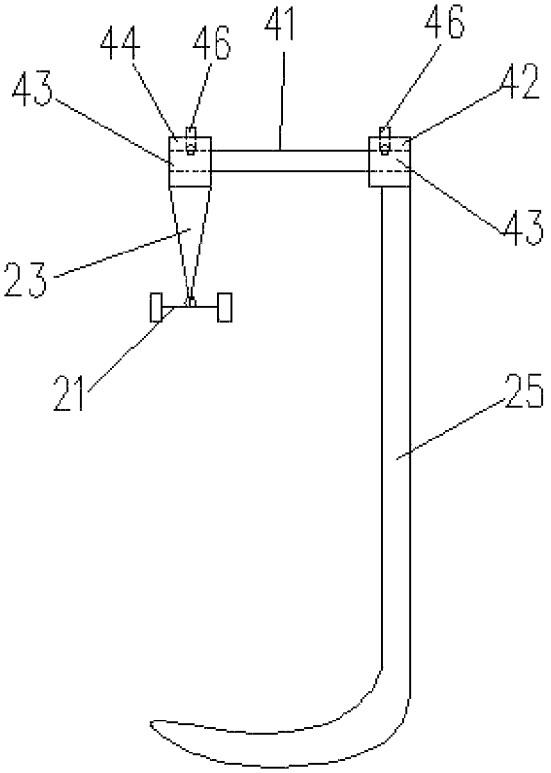
FIG. 8 is a schematic structural view of a C-shaped hanging bracket 25 according to one embodiment of the present invention.
Figure 9:
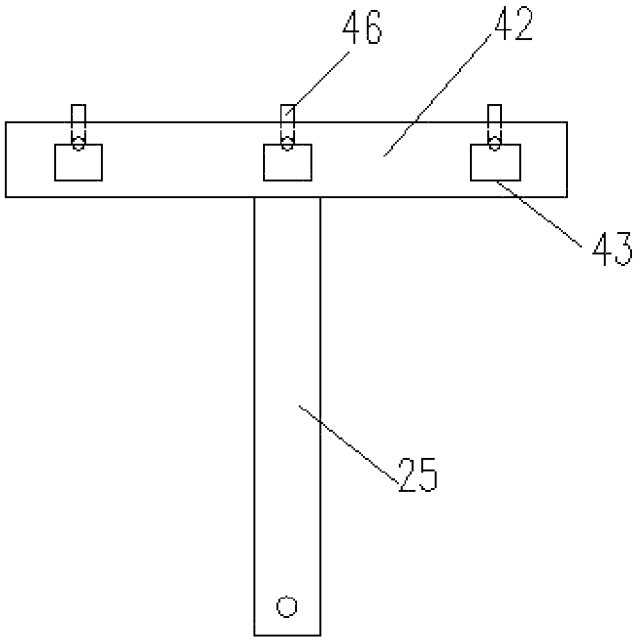
FIG. 9 is a schematic view showing that a vertical rod of the C-shaped hanging bracket 25 in FIG. 8 is connected to a hanging bracket stringer 42.

In one embodiment, referring to FIG. 7, FIG. 8 and FIG. 9, a hanging bracket hinged bridge maintenance vehicle for avoiding bridge-side obstacles includes a vehicle frame and a suspension arm capable of extending outside of a bridge, wherein the vehicle frame comprises a vehicle frame chassis 21, the suspension arm is a C-shaped hanging bracket 25, the C-shaped hanging bracket 25 includes a vertical rod 25*a* and a hook portion 25*b* extending and bending from the vertical rod 25*a*, the vehicle frame chassis 21 hinges a lower end of a strut 23 through a longitudinal shaft hinge 22 together with a longitudinal shaft 22*a*, and the hook portion 25*b* of the C-shaped hanging bracket 25 is provided with at least a fixing point for a lifting rope 26 or a lifting rope winding and unwinding device. A vehicle frame stringer 44 is fixed at an upper end of the strut 23, a hanging bracket stringer 42 is fixed at an upper end of the vertical rod 25*a* of the C-shaped hanging bracket 25, and the hanging bracket stringer 42 and the vehicle frame stringer 44 are flexibly connected with at least two cross beams 41 as a whole.

Multiple cross beams 41 connect the hanging bracket stringer 42 and the vehicle frame stringer 44 together. When encountering bridge-side obstacles such as cables or lampposts, the connection between the first cross beam 41 and the hanging bracket stringer 42 close to an obstacle is disconnected in sequence in the traveling direction of the vehicle frame. For example, the first cross beam 41 is drawn from one side of the corresponding transverse sockets 43 on the hanging bracket stringer 42 towards the vehicle frame stringer 44, so as to leave a gap that allows the obstacle to pass through between the first cross beam 41 and the hanging bracket stringer 42. Then the maintenance vehicle is pushed continuously to make the first cross beam 41 avoid the obstacle. At this time, the second cross beam 41 is at least connected between the hanging bracket stringer 42 and the vehicle frame stringer 44, which ensures normal connection and support between the vehicle frame, the strut 23 and the C-shaped hanging bracket 25 and ensures normal operation of the maintenance stand 5. The vehicle frame is pushed continuously to advance so that the transverse sockets 43 installed with the first cross beam 41 crosses the obstacle, the moveable connection between the first cross beam 41 and the hanging bracket stringer 42 is restored, and then the operation of avoiding the obstacle by the second and subsequent cross beams 41 can be performed according to the step of avoiding the obstacle by the first cross beam 41.

The hanging bracket stringer 42 and the cross beams 41 on the vehicle frame stringer 44 are arranged at intervals, and the minimum distance between the two adjacent cross beams 41 is greater than the length of the bridge-side obstacle in the longitudinal direction of the bridge, so as to ensure avoidance and alternation of more than two cross beams.

According to the embodiment of FIG. 7, FIG. 8 and FIG. 9, the vehicle frame stringer 44 and the hanging bracket stringer 42 are correspondingly provided with transverse sockets 43 at intervals. In FIG. 9, three quadrangular transverse sockets 43 are distributed in the longitudinal direction of the hanging bracket stringer 42, three transverse sockets 43 are also distributed on the vehicle frame stringer 44 correspondingly. The vehicle frame stringer 44 and the hanging bracket stringer 42 may be connected with each other through cross beams 41 installed in the three pairs of the transverse sockets 43, and the cross beams 41 are respectively provided with shafts to slide fit with the transverse sockets 43. In this embodiment, the cross beam 41 is like a shoulder pole, one end penetrating the transverse sockets 43 on the vehicle frame stringer 44, and the other end penetrating the transverse sockets 43 on the hanging bracket stringer 42, so as to connect the strut 23 and the C-shaped hanging bracket altogether. In order to ensure a safe and reliable connection between the cross beams 41 and the vehicle frame stringer 44 or the hanging bracket stringer 42 and to avoid disengagement of the cross beams 41 from the transverse sockets 43 on the vehicle frame stringer 44 or the hanging bracket stringer 42, the vehicle frame stringer 44 and/or the hanging bracket stringer 42 are/is provided with axial movement stop apparatuses 46 corresponding to the transverse sockets 43, and the shafts on two ends of the cross beams 41 are provided with positioning slots corresponding to the axial movement stop apparatuses 46. The structure of the axial movement stop apparatuses may be varied. For example, the axial movement stop apparatuses are spring hit beads. And the positioning slots are, as shown in FIG. 8, spherical recesses defined on the shafts of the cross beams 41 corresponding to the spring hit beads or, as shown in FIG. 10 and FIG. 11, annular grooves correspondingly defined on the shafts of the cross beams 41.

The transverse sockets 43 in FIG. 9 are quadrilateral holes, which may be square holes or rectangular holes, and correspondingly, cross sections of the shafts on the cross beams 41 to slide fit with the transverse sockets 43 are correspondingly squares or rectangles. Such a design of quadrilateral or polygonal holes is particularly suitable for the situation where only two cross beams 41 are arranged between the hanging bracket stringer 42 and the vehicle frame stringer 44. When two cross beams 41 are moveably connected to the hanging bracket stringer 42 and the vehicle frame stringer 44, if one cross beam 41 is disconnected from the hanging bracket stringer 42 in order to avoid obstacles, that is, one cross beam 41 is pulled towards the inner side of the bridge, so that the cross beam 41 is disconnected from the transverse sockets 43 on the hanging bracket stringer 42, only one cross beam 41 is connected between the hanging bracket stringer 42 and the vehicle frame stringer 44, and the one cross beam 41 not only needs to withstand the gravity of the maintenance stand 5 below the C-shaped hanging bracket 25, but also needs to withstand the bending moment generated by the C-shaped hanging bracket 25 or the maintenance stand 5, because the connecting position of the one cross beam 41 longitudinally deviates from the center of the C-shaped hanging bracket 25 and the maintenance stand 5. In this case, fit of the square or polygonal transverse sockets 43 and the cross beam 41 with the corresponding section can overcome torque generated by the bending moment, thereby avoiding twists of the cross beam 41. In this case, if the transverse sockets 43 are circular and the section of the cross beam 41 is circular, the transverse sockets 43 may rotate about the cross beam 41, resulting the C-shaped hanging bracket 25 and the maintenance stand 5 deflecting the cross beam 41. When three or more cross beams 41 are connected between the hanging bracket stringer 42 and the vehicle frame stringer 44, more than two cross beams 41 are connected between the hanging bracket stringer 42 and the vehicle frame stringer 44 during the operation of avoiding obstacles, so that there are two points on the vehicle frame stringer 44 for supporting. In this case, the bending moment generated due to the eccentricity of the C-shaped hanging bracket 25 and the maintenance stand 5 is borne by the vehicle frame stringer 44. And no matter whether the cross sections of the transverse sockets 43 and the cross beams 41 are circular or polygonal, no cross beam 41 would not rotate or the C-shaped hanging bracket 25 and the maintenance stand 5 would not deflect.

Figure 10:
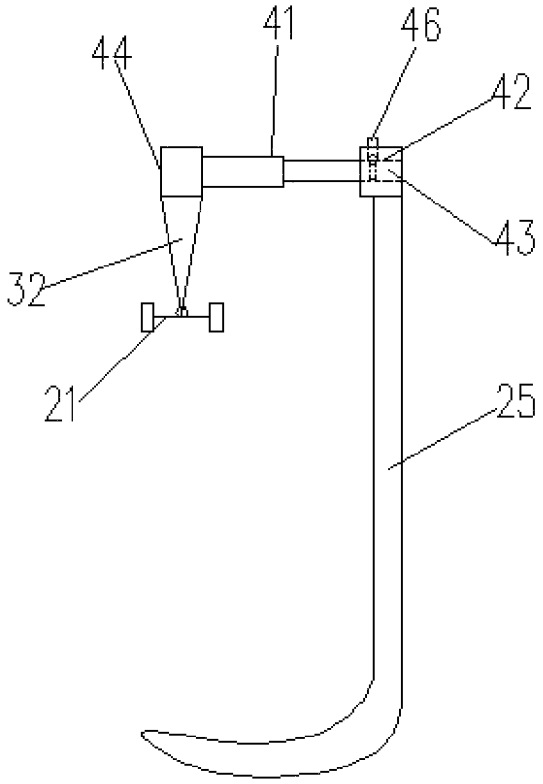
FIG. 10 is a schematic structural view of a C-shaped hanging bracket 25 according to another embodiment of the present invention.

In another embodiment, referring to FIG. 10, another structure is that the hanging bracket stringer 42 is provided with transverse sockets 43 corresponding to the cross beams 41, the cross beams 41 are telescopic beams with more than two sections, wherein the fixed parts of the telescopic beams are fixed to or hinged the vehicle frame stringer 44, and front ends of telescopic portions of the cross beams 41 are provided with shafts to slide fit or threaded connected with the transverse sockets 43 on the hanging bracket stringer 42. After the telescopic portions of the cross beam 41 are retracted, the minimum distance from the vehicle frame stringer 44 to the cross beam 41 should be less than the minimum distance between the vehicle frame stringer 44 and the bridge-side obstacles in the horizontal direction of the bridge, so as to prevent that the telescopic portions of the cross beam 41 from blocking when avoiding the obstacles. When the cross beams 41 are telescopic beams, the telescopic beams may has the same structure as an arm of a crane. That is, the telescopic beams use a box beam structure, in which telescopic hydraulic cylinders are mounted internally, and hydraulic systems in communication with the telescopic hydraulic cylinders are mounted on the vehicle frame chassis 21 or the vehicle frame stringer 44, so as to ensure normal extension and contraction of the telescopic beams. The telescopic beams surely may also be provided with a linear reciprocating mechanism such as a jack or a screw rod to make the cross beams 41 become telescopic beams. The cross beams 41 and the transverse sockets 43 may also be connected in the following manner: the transverse sockets 43 may be internally provided with inner threads, and the front ends of the telescopic portions of the cross beams are correspondingly provided with outer threads, the front ends of the telescopic portions of the cross beams are driven to rotate through rotation of the screw rod, so as to engage with the inner threads of the transverse sockets 43.

Figure 11:
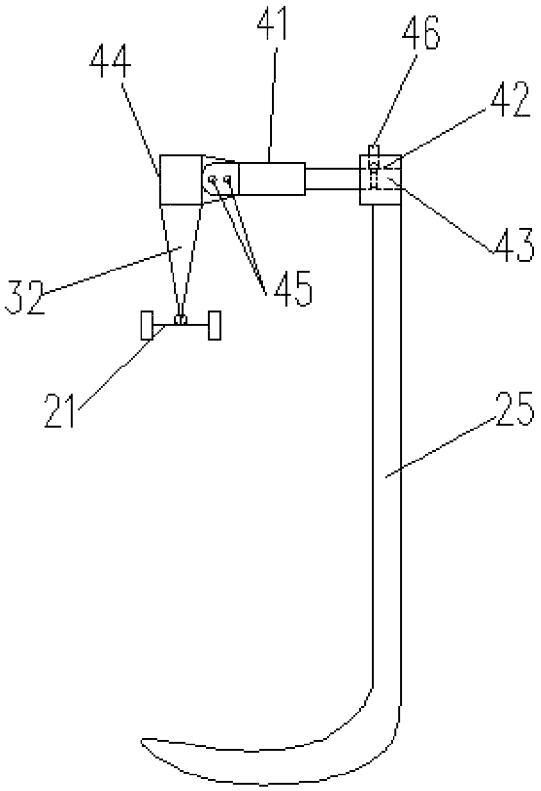
FIG. 11 is a schematic structural view of a C-shaped hanging bracket 25 according to another embodiment of the present invention.

In another embodiment, referring to FIG. 11, another structure is the improvement of the cross beams 41 in FIG. 10. The fixing portions of the telescopic beams hinges the vehicle frame stringer 44, and the front ends of the telescopic portions of the cross beams 41 are provided with shafts to slide fit or threaded connect with the transverse sockets 43 on the hanging bracket stringer 42. For example, two longitudinal bolts 45 are used on fixing ends of the upper cross beams 41 for fixation, or a bayonet lock is mounted near a hinge shaft connecting a hinge base and the fixing ends of the cross beams 41 corresponding to the hinge base and the cross beams 41. Such structure is applicable when there are a small number of sections of the cross beams 41 and when the remaining beam segment is too long to avoid the obstacles after retraction of the telescopic ends of the cross beams 41, which is beneficial to reducing telescopic sections of the cross beams. In combination with FIG. 7, when the structure needs to avoid a lamppost 3 on a side of the bridge, a telescopic end of a cross beam 41 may first exit from the transverse sockets 43 on the hanging bracket stringer 42. Then one bolt 45 is removed, so that the cross beam 41 swings about the other bolt 45 upwards or downwards to avoid the lamppost 3 in the width direction of the deck. The maintenance vehicle of this embodiment is then pushed to advance, so that the cross beam 41 crosses the lamppost 3 in the longitudinal direction of the bridge. And finally the cross beam 41 is lay flat and the unplugged bolt 45 is plugged in, so that the telescopic ends of the cross beam 41 expands and inserts into the transverse sockets 43. That is, the operation of avoiding the lamppost 3 by one cross beam 41 is completed. The operation of avoiding the lamppost 3 by the subsequent cross beams 41 is performed in sequence like this, that is, a single vehicle may avoid the bridge-side obstacles without affecting the underbridge maintenance operation. It is demonstrated that the process of the maintenance vehicle to avoid obstacles according to the embodiment of the present invention is easy to operate, safe and reliable, can be performed where the operation of the maintenance stand 5 below the deck is not interrupted, and has higher construction efficiency.

Figure 12:
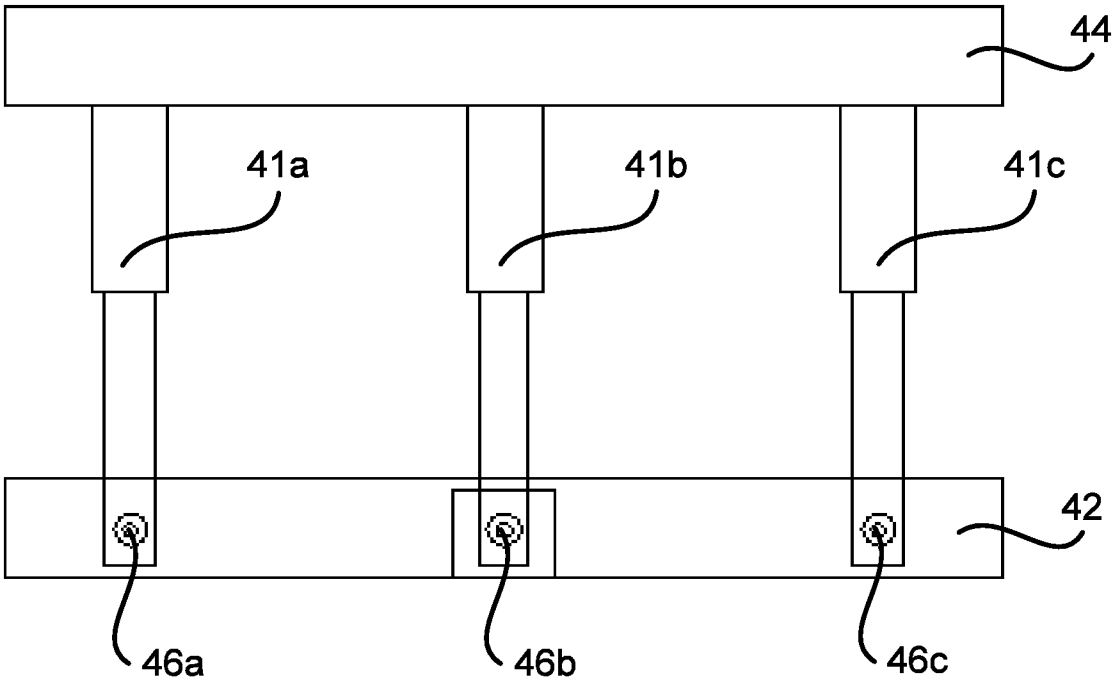
FIG. 12 is a schematic top view of the hanging bracket hinged bridge maintenance vehicle of FIGS. 7-9.

FIG. 12 is a schematic top view of the hanging bracket hinged bridge maintenance vehicle of FIGS. 7-9. Referring to FIG. 9 and FIG. 12, the cross beam 41 includes a first cross beam 41, a second cross beam 41*b*, and a third cross beam 41*c*. The axial movement stop apparatus 46 includes a first axial movement stop apparatus 46*a*, a second axial movement stop apparatus 46*b*, and a third axial movement stop apparatus 46*c*.

Figure 13A:
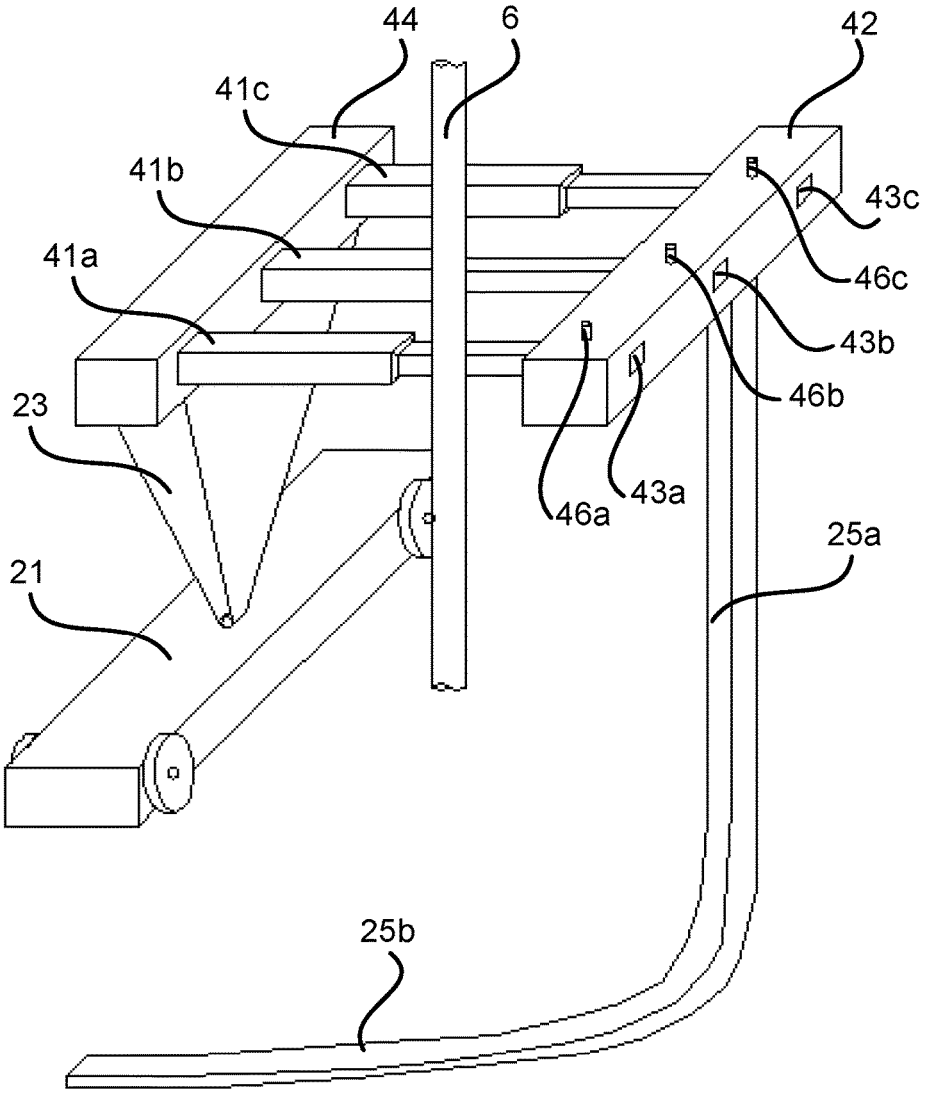
FIGS. 13A-13C are schematic three-dimensional views of the hanging bracket hinged bridge maintenance vehicle of FIGS. 7-9, where moving of the maintenance vehicle passing through an obstacle is shown.
Figure 13B:
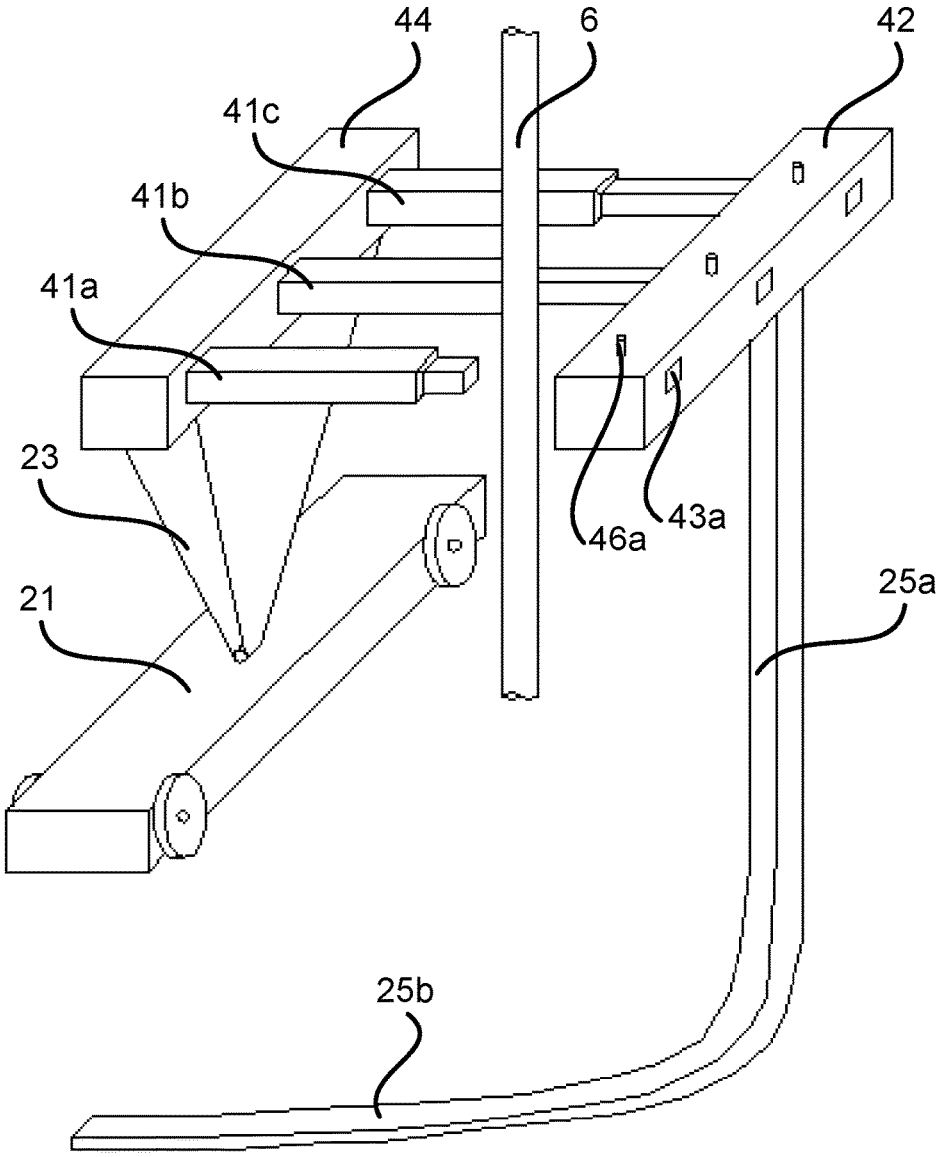
Figure 13C:
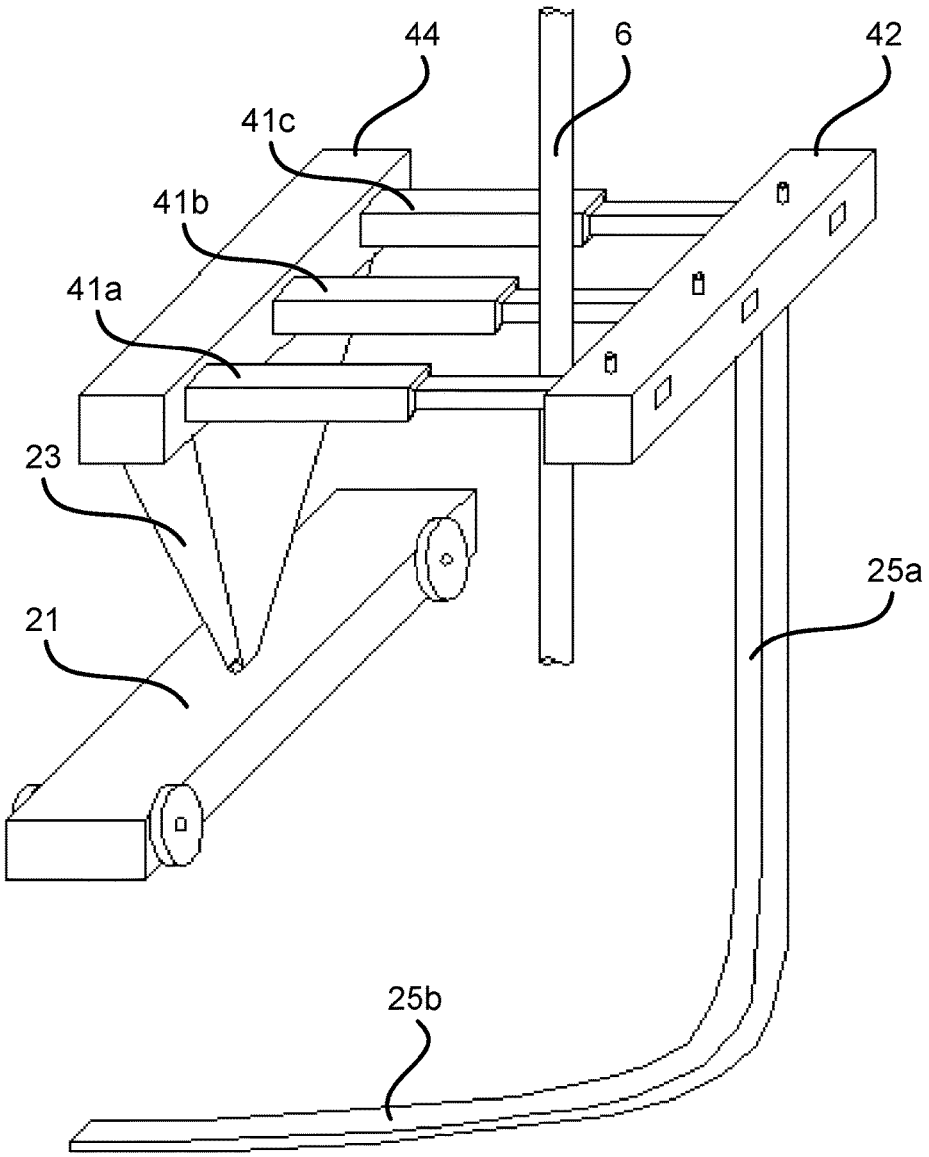

FIGS. 13A-13C are schematic three-dimensional views of the hanging bracket hinged bridge maintenance vehicle of FIGS. 7-9, where moving of the maintenance vehicle passing through an obstacle is shown. In certain embodiment, as shown in FIG. 13A, the maintenance vehicle encounters an obstacle 6 on the upper surface of the bridge that is close to the first cross beam 41*a*. As shown in FIG. 13B, the first cross beam 41*a* is disconnected from the hanging bracket stringer 42 to leave a gap between the first cross beam 41*a* and the hanging bracket stringer 42. Then, the maintenance vehicle is pushed such that the obstacle 6 enters from the gap. At this time, the second cross beam 41*b* and the third cross beam 41*c* are connected between the hanging bracket stringer 42 and the vehicle frame stringer 44, which ensures normal connection and support between the vehicle frame, the strut 23 and the C-shaped hanging bracket 25 and ensures normal operation of the maintenance stand 5. As shown in FIG. 13C, the maintenance vehicle is further pushed so that the transverse socket 43*a* crosses the obstacle 6, and the first cross beam 41*a* is then reinstalled. Now the obstacle 6 is located between the reinstalled cross beam 41*a* and the cross beam 41*b*. After that, the above process can be repeated by disconnecting and reinstalling the second cross beam 41*b*, and disconnecting and reinstalling the third cross beam 41*c*. Accordingly, the maintenance vehicle allows the obstacle 6 to enter from the side having the first cross beam 41*a* and exit from the side having the third cross beam 41*c*. During this process, the maintenance vehicle passes the obstacle 6 without the need of disassembling and reassembling the whole maintenance vehicle, and without the need of using two maintenance vehicles.

Figure 14C:
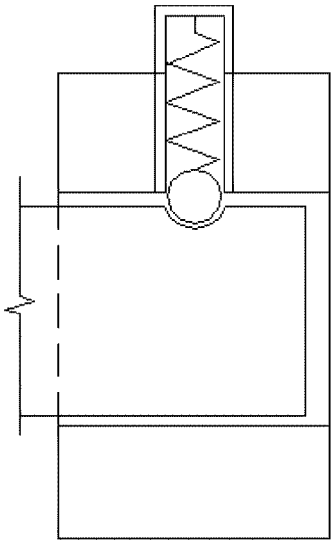
FIGS. 14A-14C are schematic side views of the spring hit head of the hanging bracket hinged bridge maintenance vehicle according to one embodiment of the present invention.
Figure 14B:
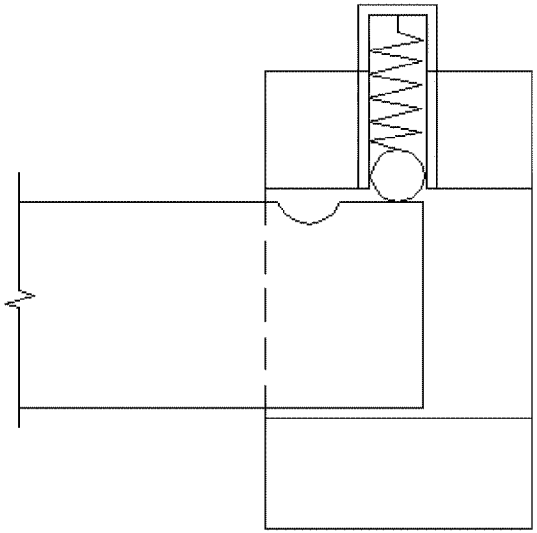
Figure 14A:
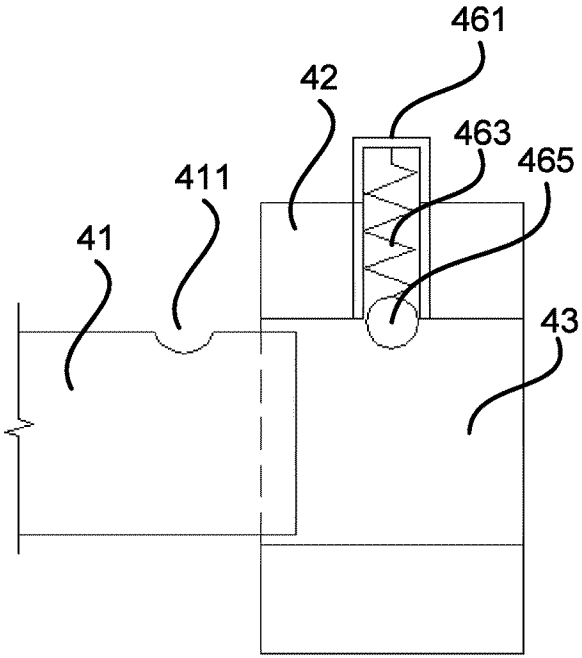

As described above, the axial movement stop apparatus 46 may be a spring hit bead. FIGS. 14A-14C are schematic side views of the spring hit bead of the hanging bracket hinged bridge maintenance vehicle according to one embodiment of the present invention. The spring hit bead 46 includes a frame 461 movably fixed to the hanging bracket stringer 42, a spring 463, and a bead or ball 465. The spring 463 is received in an inner cavity of the frame 461. One end of the spring 463 is fixed to the top of the inner cavity, the other end of the spring 463 is fixedly connected with the bead 465. The cross beam 41 has a recess 411 concavely formed at one end. The recess 411 has a shape corresponding to the shape of the bead 465 and used for receiving part of the bead 465. Referring to FIGS. 14A-14C, when the cross beam 41 is inserted into the transverse socket 43, the insertion end of the cross beam 41 moves the bead 465 upward, and the bead 465 slides on the top surface of the cross beam 41. Once the bead 465 slides to the position of the recess 411, the bead 465 is received in the recess 411 such that the cross beam 41 is fixed to the hanging bracket stringer 42. When the cross beam 41 needs to be disconnected from the hanging bracket stringer 42, the spring hit bead 46 may be moved up to detach the bead 465 from the recess 411, such that the cross beam 41 may be removed from the transverse socket 43 of the hanging bracket stringer 42.

The foregoing description of the exemplary embodiments of the present invention has been presented only for the purposes of illustration and description and is not intended to be exhaustive or to limit the present invention to the precise forms disclosed. Many modifications and variations are possible in light of the above teaching.

The embodiments were chosen and described in order to explain the principles of the present invention and their practical application so as to enable others skilled in the art to utilize the present invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A bridge maintenance vehicle, comprising:

a vehicle frame comprising a chassis;

a longitudinal shaft hinge;

a strut, having a lower end and an upper end;

a vehicle frame stringer disposed along a longitudinal direction;

a hanging bracket stringer disposed along the longitudinal direction;

two or more cross beams, each having a first end and an opposite, second end, and disposed along a transverse direction, wherein the two or more cross beams are arranged in parallel to each other, and perpendicular to the vehicle frame stringer and the hanging bracket stringer; and a suspension arm, having a vertical rod and a hook portion extending and bending from the vertical rod, the hook portion of the suspension arm having at least one fixing point for fixing a lifting rope or a lifting rope winding and unwinding device, wherein the chassis is configured to be located at an upper surface of a bridge, the chassis is hinged to the lower end of the strut through the longitudinal shaft hinge, the upper end of the strut is fixed to the vehicle frame stringer, the first end of each of the cross beams is fixed to the vehicle frame stringer, the second end of each of the cross beams is connected to the hanging bracket stringer, an upper end of the vertical rod of the suspension arm is fixed to the hanging bracket stringer;

wherein the suspension arm is capable of extending outside of the bridge, and the at least one fixing point is configured to be located below a lower surface of the bridge; and wherein each of the cross beams is removable from the hanging bracket stringer, such that the bridge maintenance vehicle is operably moveable across an obstacle on the bridge by sequentially disconnecting a first cross beam of the cross beams from the hanging bracket stringer so as to define a gap between the first cross beam and the hanging bracket stringer that allows the obstacle to pass through the first cross beam and reconnecting the first cross beam to the hanging bracket stringer when the bridge maintenance vehicle is moved to make the obstacle pass the first cross beam through the gap, and repeatedly disconnecting an immediately next cross beam of the cross beams from the hanging bracket stringer and reconnecting the next cross beam to the hanging bracket stringer when the bridge maintenance vehicle is moved to make the obstacle pass the next cross beam until the bridge maintenance vehicle is moved to make the obstacle pass a last cross beam of the cross beams.

2. The bridge maintenance vehicle according to claim 1, wherein a distance between any two adjacent cross beams of the two or more cross beams is greater than a length of the obstacle in the longitudinal direction of the bridge.

3. The bridge maintenance vehicle according to claim 1, wherein the vehicle frame stringer and the hanging bracket stringer are provided with transverse sockets, and the first end of each of the two or more cross beams is configured to slide fit with corresponding one of the transverse sockets disposed on the vehicle frame stringer, and the second end of each of the two or more cross beams is configured to slide fit with corresponding one of the transverse sockets disposed on the hanging bracket stringer.

4. The bridge maintenance vehicle according to claim 3, wherein at least one of the vehicle frame stringer and the hanging bracket stringer is provided with at least one axial movement stop apparatus disposed at one of the transverse sockets, and wherein at least one positioning slot is correspondingly defined on the first end or the second end of at least one of the two or more cross beams, and is configured to receive the at least one axial movement stop apparatus.

5. The bridge maintenance vehicle according to claim 4, wherein the at least one axial movement stop apparatus comprises a spring and a bead connected with the spring, the at least one positioning slot is a spherical recesses or annular grooves, and the bead of the at least one axial movement stop apparatus is insertable to the at least one positioning slot through an elastic force of the spring.

6. The bridge maintenance vehicle according to claim 1, wherein the hanging bracket stringer is provided with a plurality of transverse sockets corresponding to the two ore more cross beams, the two ore more cross beams are telescopic beams with more than two sections, the first end of each of the two or more cross beams is fixed to or hinged to the vehicle frame stringer, and the second end of each of the two or more cross beams slides fit or is connected by thread with corresponding one of the transverse sockets on the hanging bracket stringer.

* * * * *